US009850586B2

(12) United States Patent
Gusev et al.

(10) Patent No.: US 9,850,586 B2
(45) Date of Patent: Dec. 26, 2017

(54) LINING FOR AN ALUMINUM ELECTROLYZER HAVING INERT ANODES

(71) Applicant: United Company RUSAL Engineering and Technology Centre LLC, g. Krasnoyarsk (RU)

(72) Inventors: Aleksandr Olegovich Gusev, Krasnoyarsk (RU); Aleksey Gennad'evich Burtsev, Krasnoyarsk (RU); Sergey Vladimirovich Skuratov, Krasnoyarsk (RU); Vyacheslav Georgievich Grigor'ev, Irkutsk (RU); Sergey Viktorovich Tepikin, Irkutsk (RU); Aleksandr Victorovich Ermakov, Irkutsk (RU); Boris Sergeevich Efremov, Irkutsk (RU); Yuriy Vasil'evich Shemet, Irkutsk (RU)

(73) Assignee: UNITED COMPANY RUSAL ENGINEERING AND TECHNOLOGY CENTRE LLC, g. Krasnoyarsk (RU)

( * ) Notice: Subject to any disclaimer, the term of this patent is extended or adjusted under 35 U.S.C. 154(b) by 200 days.

(21) Appl. No.: 14/441,450

(22) PCT Filed: Nov. 13, 2012

(86) PCT No.: PCT/RU2012/000933
§ 371 (c)(1),
(2) Date: May 7, 2015

(87) PCT Pub. No.: WO2014/077720
PCT Pub. Date: May 22, 2014

(65) Prior Publication Data
US 2015/0284863 A1 Oct. 8, 2015

(51) Int. Cl.
*C25C 3/08* (2006.01)
*C25C 3/16* (2006.01)

(52) U.S. Cl.
CPC . *C25C 3/08* (2013.01); *C25C 3/16* (2013.01)

(58) Field of Classification Search
CPC .. C25C 3/08; C25C 3/06; C25C 3/085; C25C 3/12; C25C 3/16; C25C 7/005; C25C 7/025; C25C 3/00
(Continued)

(56) References Cited

U.S. PATENT DOCUMENTS 2,528,905 A * 11/1950 Ollivier ..... C25C 3/08 204/247.5
3,607,685 A * 9/1971 Johnson ..... C25C 3/085 204/244
(Continued)

FOREIGN PATENT DOCUMENTS

RU 2281986 8/2006
RU 2011114886 10/2012
(Continued)

OTHER PUBLICATIONS

Machine translation of RU2482224 C2 from Espacenet.*

*Primary Examiner* — Harry D Wilkins, III
(74) *Attorney, Agent, or Firm* — Hogan Lovells US LLP

(57) ABSTRACT

The invention provides a lining for an aluminium electrolyzer having inert anodes and is enclosed in a cathode casing comprising a bottom formed from taller blocks having projections and shorter bottom blocks. The shorter bottom blocks are mounted at the ends of the bottom of the cathode device. The shorter bottom blocks alternate with the taller bottom blocks having projections. Vertical channels are provided in the projections of the blocks over the entire thickness of the block for the mounting of conductive elements formed from aluminium and are attached in the
(Continued)

lower part to a current-carrying collector that is in the form of a plate which extends out of the ends of the bottom blocks and through the longitudinal sides of the cathode casing.

4 Claims, 4 Drawing Sheets

(58) Field of Classification Search
USPC ..... 204/247.4
See application file for complete search history.

(56) References Cited

U.S. PATENT DOCUMENTS 3,723,287 A * 3/1973 Elliott ..... C25C 3/08 204/245
4,613,418 A * 9/1986 Dewing ..... C25C 3/08 204/247.1
5,683,559 A 11/1997 de Nora
8,206,560 B2 * 6/2012 Feng ..... C25C 3/08 204/243.1
2010/0147678 A1 * 6/2010 Feng ..... C25C 3/08 204/247.3
2013/0032486 A1 * 2/2013 Ruan ..... C25C 7/005 205/372
2013/0112549 A1 * 5/2013 Feng ..... C25C 3/08 204/242
2013/0319853 A1 * 12/2013 Hiltmann ..... C25C 3/08 204/294
2014/0138240 A1 * 5/2014 Martin ..... C25C 3/08 204/244
2015/0284863 A1 * 10/2015 Gusev ..... C25C 3/08 204/247.4
2015/0337446 A1 * 11/2015 Gusev ..... C25C 3/08 204/287

FOREIGN PATENT DOCUMENTS

RU 2011114886 A * 10/2012 ..... C25C 3/08
RU 2482224 C2 * 5/2013 ..... C25C 3/08
WO 02/097168 12/2002
WO 2008/106849 9/2008

* cited by examiner

LINING FOR AN ALUMINUM ELECTROLYZER HAVING INERT ANODES

This application is a U.S. National Phase under 35 U.S.C. §371 of International Application No. PCT/RU2012/000933, filed on Nov. 13, 2012. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The invention pertains to nonferrous metallurgy, particularly the electrolytic production of aluminum, and specifically the lining of an aluminum electrolyzer.

There is a known lining for an aluminum electrolyzer made of blocks of refractory concrete. The concrete mixture is prepared in the following proportion: 15% quick-setting cement, 85% anthracite aggregate, 10% lime and 6% water. After forming the blocks by classical methods of vibration compaction, they go to a drying chamber for setting and removal of the bulk of the water at a temperature of 450° C. Placement of the blocks in the electrolyzer and joining of the seams is done by the traditional method (81, inventor's certificate No. 1050574, C 25 C 3/08, published 23 Oct. 83).

The drawback with this lining for an aluminum electrolyzer is the fact that in such a method of fabrication of the blocks with anthracite aggregate oxidation of the carbon component of the refractory blocks by air from the outside will occur during the operation of the electrolyzer, through openings in the cathode casing, and from the inside (the melt side), by carbon monoxide (CO). As a result of this, the refractory blocks will be destroyed, which afterwards results in electrolyte melt getting into the cathode casing and, in the worst case scenario, metal and electrolyte will escape from the vat.

There is also known a lining for an aluminum electrolyzer (multiple-cell type) made of precast blocks based on cryolite in a mixture with aluminum oxide (alumina) and carbonaceous material. The blocks are made as follows: a defined quantity of fragmented carbonaceous material is poured into a casting mold, around 20 wt. % of aluminum oxide is added, and the whole is cast in previously melted cryolite. From the resulting blocks, the bottom and side lining is laid out, a layer of powderlike or molten cryolite is applied to the surfaces being joined, and then the entire lining is heated to seal the blocks to each other and form a single monolith (USSR patent No. 252224, C 22 Б 3/02, 3/12, published 10 Sep. 69).

The drawback with this design of a lining for an aluminum electrolyzer is the fact that when using such blocks based on cryolite with a melting point of 1010° C. there is always a risk of melting of the blocks as a result of a disruption in the technological process and rise in the melt temperature.

The closest to the proposed invention is a lining for an aluminum electrolyzer in which the bottom is made of refractory, noncarbon material (concrete), and is covered with a layer of titanium diboride, which does not react with liquid aluminum. The conductive elements are made of aluminum in the form of a truncated cone, liquid in the upper part in contact with the cathode aluminum melt, and solid in the lower part in contact with the cathode busbar, and they are installed passing vertically through the bottom (RF patent No. 2281986, C25C 3/08, published 20 Aug. 2006).

This design makes it possible to eliminate horizontal currents in the cathode and, accordingly, reduce the circulation and the wave formation at the boundary between the metal and the electrolyte, which has a direct impact on the current yield and electric power consumption parameters; reduce the filtration of the melt through the bottom and at the boundaries between the cathode conductive element and the lining; lessen the penetration of alkaline metals into the bottom and thereby ensure a longer service life of the electrolyzer.

However, the installing of the vertical conductive elements in the monolithic bottom, laid in 4-5 layers, is extremely inefficient: first of all, it requires a complex formwork; secondly, the pouring of concrete in a volume of 50-60 tons is a rather complicated and costly process; thirdly, the curing and warm up of such a concrete lining will take between 10 and 20 days, or else an explosive release of steam is possible, resulting in destruction of the lining.

Furthermore, the use of conductive elements in the form of an inverted truncated cone, whose upper part is in the liquid state while the lower part is solid, means that alumina not dissolved in the electrolyte will settle onto the bottom of the vat and plug up the channels of the conductive elements in the bottom. This will result in an increased voltage gradient in the cathode, and in the worst case scenario it may even result in total loss of contact between the liquid cathode and the solid parts of the conductive elements, which in turn cause a rupture in the series of electrolyzers and thereby sharply reduce the energy efficiency of the operation of the electrolyzer.

What is more, the installing and making of the conductive elements in the form of an inverted cone with a ratio of the upper to the lower cross sectional area of 1:2 and in a quantity equal to or greater than the number of anodes in the prototype has serious drawbacks in the form of a substantial removal of heat by the conductive elements from the aluminum, which needs to be replenished by increasing the gap between electrodes. This will increase the outlay of electricity needed to make a ton of electrolytic aluminum. And the lower cross sectional area is dictated by the allowable current density for aluminum of 0.65 $A/mm^2$. This means that for an electrolyzer rated for a current strength of 120 kA with 16 anodes, and 16 conductive elements, the diameters of the latter will be Ø 120 mm in the lower and Ø 170 mm in the upper part, respectively.

The problem solved by the invention is to develop an energy-efficient design of the lining, making it possible to lower the electricity spent on producing aluminum and ensuring a trouble-free operation of the electrolyzer by preventing a clogging of the channels with conductive elements in the bottom.

The technical result is to lessen the removal of heat by the conductive elements from the aluminum and to obtain a stable electrical resistance of the conductive elements throughout the service life of the electrolyzer.

The solution of the stated problem is achieved according to the proposed invention in that, in the lining of an aluminum electrolyzer with inert anodes, enclosed in a cathode casing, including a bottom made from refractory noncarbon material, and conductive elements of aluminum, which are liquid in the upper part in contact with the aluminum melt and solid in the lower part, and installed passing vertically through the bottom, the bottom is made of taller bottom blocks having projections and shorter bottom blocks, the shorter bottom blocks being mounted at the end faces of the bottom, wherein the shorter bottom blocks alternate with the taller bottom blocks having projections, and vertical channels are provided in the projections of the blocks over the entire thickness of the block for the mounting of the conductive elements, while the conductive elements are fastened in the lower part to a current-carrying collector in the form of a plate which extends horizontally out from the end faces of the bottom blocks and through the longitudinal sides of the cathode casing.

Having taller and shorter bottom blocks, and providing the taller bottom blocks with projections, and having channels in them for the conductive elements, while the entry to the channel is situated higher than the level of the bottom, makes it possible to decrease the likelihood of clogging of the channels and reduce the losses of electricity.

Connecting the conductive elements to a current-carrying collector in the form of a plate extending horizontally out from the end faces of the blocks, unlike the vertical extraction at the bottom (in the prior art), enables a substantial lowering of the thermal losses, which means less expenditure of electricity to produce a ton of aluminum. The plates are situated inside the casing, and most of the heat remains in the vat.

The invention is supplemented by particular distinguishing features making it possible to achieve the stated goal.

According to claim 2, in order to totally eliminate instances of clogging of the channels with the conductive elements in the bottom with alumina, the conductive elements are L-shaped or T-shaped, making it possible to situate the channel exit on the lateral surface of the projection of the bottom block.

According to claim 3, the bottom blocks are made of high-alumina refractory concrete which is roasted up to 1200° C. or they are made of several layers, a working layer made of high-alumina concrete with thickness of 0.4 to 0.6 of the thickness of the block, and a secondary layer made of alumosilicate concrete, for the rest.

At a temperature of 1200° C. the process of sintering of the concrete components takes place, ceramic bonds are formed and the concrete takes on its maximum strength. When electrolyte components soak through the working layer, and penetrate into the secondary layer, the electrolyte will enter into reaction to form albite, which in turn will dissolve the metal fluorides and create a highly viscous glasslike silicate system, preventing further penetration of the electrolyte components.

According to claim 4, the seams between the individual bottom blocks are filled with refractory high-alumina concrete with reduced viscosity or by means of an adhesive or cementing composition with a seam thickness of 5-20 mm.

Filling the seams between blocks with refractory high-alumina concrete with reduced viscosity ensures that the seams can be filled to full height, even for a complex profile of the lateral surface of the bottom block. The joining of the seams by means of an adhesive or cementing composition reduces the area of the seams between blocks, and produces a monolithic bottom, which in turn lessens the likelihood of electrolyte leaking into the lining.

The essence of the invention is explained by the graphic material.

Figure 1:
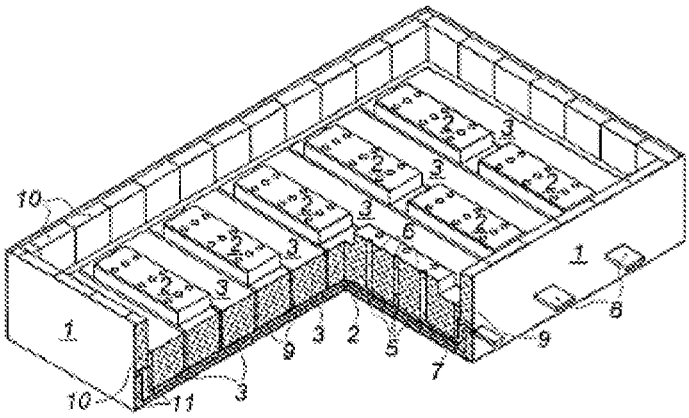
FIG. 1 shows the proposed liner of an aluminum electrolyzer, shown with a quarter cut out.
Figure 2:
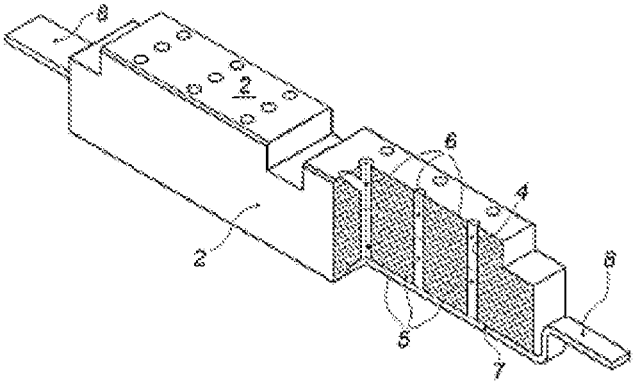
FIG. 2 shows a bottom block in assembled form, with a cut out.
Figure 3:
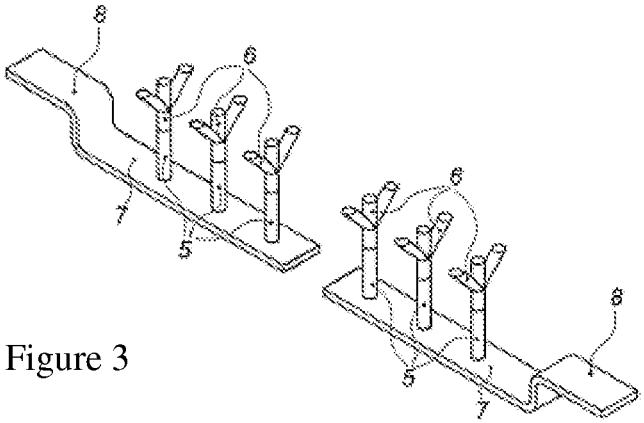
FIG. 3 shows conductive elements in assembled form with the current-carrying collector.
Figure 4:
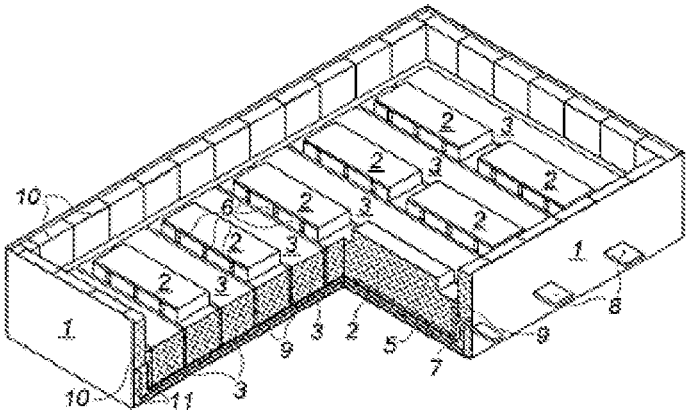
FIG. 4 shows the lining of an aluminum electrolyzer with conductive elements of L-shape.
Figure 5:
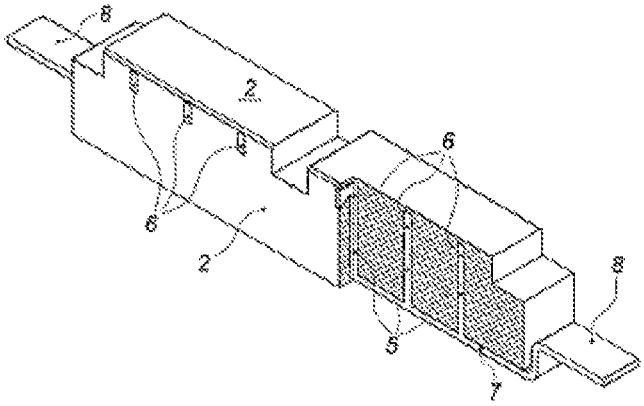
FIG. 5 shows a bottom block with conductive elements of L-shape.
Figure 6:
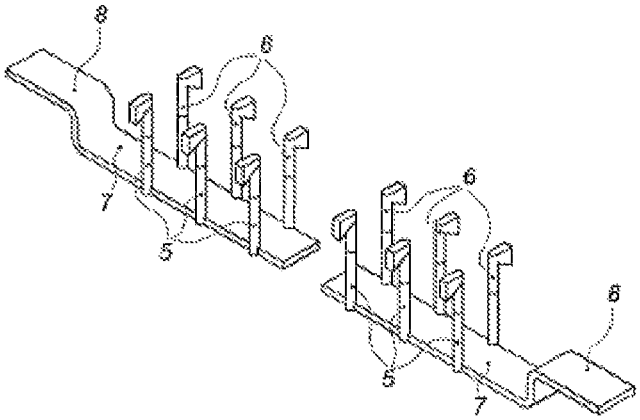
FIG. 6 shows conductive elements of L-shape in assembled form with the current-carrying collector.
Figure 7:
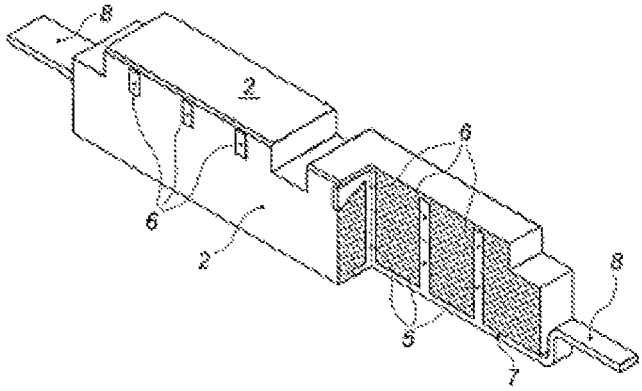
FIG. 7 shows a bottom block with conductive elements of T-shape.
Figure 8:
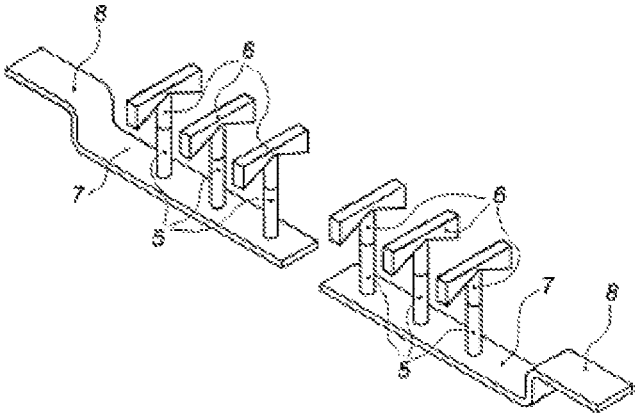
FIG. 8 shows conductive elements of T-shape in assembled form with the current-carrying collector.
Figure 9:
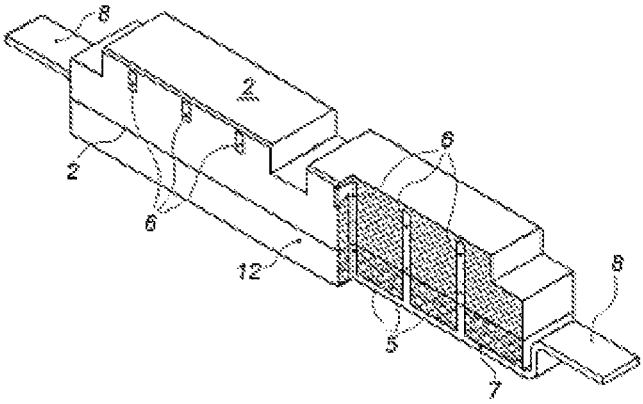
FIG. 9 shows a bottom block in assembled form according to claim 6.

The lining of an aluminum electrolyzer with inert anodes includes a steel cathode casing 1, taller bottom blocks with projections 2, shorter bottom blocks 3, conductive elements 5 of aluminum installed in channels 4 of the bottom blocks 2, with a liquid part 6, a current-carrying collector 7 of aluminum plate with a part 8 extending to the outside, seams 9 of high-alumina concrete between the blocks, edge blocks 10, layers of refractory brick, such as brick made from high-alumina, magnesia, periclase carbonaceous fire clay brick, and thermal insulating materials 11, which can be made from lightweight fire clay, vermiculite, foam diatomite, calcium silicate, and a secondary layer of the bottom block 12 made of alumosilicate concrete.

In order to completely prevent instances of clogging of the channels with the conductive elements in the bottom with alumina, the conductive elements 5 are in an L or T shape, i.e., the upper part of the conductive element 6 is turned at a 90° angle with the channel exiting onto the lateral surface of the projection of the block 2 in the case of the L-shape. Or in the case of the T-shaped block, the upper part of the conductive element 6 splits in two and also emerges onto the lateral surfaces of the projection of the bottom block 2.

For better filling of the seams between the bottom blocks, it is proposed to use a refractory high-alumina concrete with reduced viscosity, i.e., to use self-leveling concrete. After mixing with a small amount of water, it forms concrete which spreads and degasses without the use of vibration. It has all the benefits of low-cement concretes (low porosity, high density, strength, abrasion resistance, thermal resistance), and it forms a smooth mirror surface. The use of such concrete is advisable for the lining of hard to reach places, such as the seams between the blocks.

To form a monolithic bottom of bottom blocks, one can glue them together. Such a method of joining reduces the area of the seams between blocks and ensures a monolithic bottom, which in turn reduces the likelihood of electrolyte leaking into the lining. For this, one can use an adhesive or cementing composition, the thickness of the seam will be 5-20 mm.

Typically, blocks of refractory high-alumina concrete are roasted to a temperature of 900° C.; in the present instance, it is proposed to roast them to 1200° C. At this temperature, the process of sintering of the concrete components takes place, ceramic bonds are formed, and the concrete takes on its maximum strength. In this case, the bottom blocks have heightened resistance to the cryolite/alumina melt.

In the event that the bottom blocks are made from several layers, a working layer of high-alumina concrete with a thickness of 0.4-0.6 of the thickness of the block, and a secondary layer made of alumosilicate concrete, when the working layer is impregnated with the electrolyte components the electrolyte will enter into the secondary layer and enter into a reaction, forming albite. This, in turn, will dissolve the metal fluorides and form a highly viscous glasslike silicate system, preventing further penetration of the electrolyte components.

The lining of an aluminum electrolyzer with inert anodes is assembled as follows.

The bottom of refractory high-alumina concrete, made of individual blocks which after being shaped go through stages of drying and roasting, is assembled in the space of 5-8 hours, the quality of the blocks being better than that of a monolithic bottom cast in situ.

First of all the bottom blocks are assembled; for this, a previously connected current-carrying collector with conductive elements (vertical rods) is placed in the shaped bottom block and secured there, after which the bottom block is transported to the site of assembly of the lining.

After assembly and installation of the steel cathode casing 1, its bottom is lined with refractory and thermal insulating materials 11, after which the surface of the refractory layer is covered with a layer of loose material, playing the role of a leveling cushion, on which the bottom blocks are set, with a certain spacing, so as to have a gap of 30-50 mm between adjacent blocks, in order to create the seam 9 between blocks. After this, the side lining or "brim" is laid, situated along the perimeter of the cathode casing between the bottom blocks and the lower part of the walls of the cathode casing and consisting of a layer of thermal insulating material, packed against the walls of the casing, and refractory material packed against the thermal insulating material. The projecting parts of the current-carrying collectors are clad with the lateral lining, ensuring tightness of the "brim" while at the same time not impeding the thermal expansion of the aluminum collectors. The "brim" is the base for installation of the edge lining. The installing of the edge blocks of nonmetallic refractory compounds is done in a single row along the walls of the casing 1, gluing them to the walls of the casing, and lubricating all of the bearing and joining surfaces. One can use as the adhesive or cementing composition gunite, mortar, or refractory concrete containing silicon carbide powder.

The culminating and critical operation in the assembly of the lining is the filling of the seams between the bottom blocks.

The proposed lining of an aluminum electrolyzer with inert anodes enables an assembly with less labor intensity, it improves the technical and economic indicators of the operation by lowering the expenditure of electricity, and it increase the operating reliability of the electrolyzer by preventing clogging of the channels with the conductive elements in the bottom.

The invention claimed is:

1. Lining of an aluminum electrolyzer with inert anodes, enclosed in a cathode casing, including a bottom made from refractory noncarbon material, and conductive elements of aluminum, which are liquid in the upper part in contact with the aluminum melt and solid in the lower part, and installed passing vertically through the bottom, characterized in that the bottom is made of taller bottom blocks having projections and shorter bottom blocks, the shorter bottom blocks being mounted at the end faces of the bottom, wherein the shorter bottom blocks alternate with the taller bottom blocks having projections, and vertical channels are provided only in the projections of the blocks over the entire thickness of the block for the mounting of the conductive elements, while the conductive elements are fastened in the lower part to a current-carrying collector in the form of a plate which extends horizontally out from the end faces of the bottom blocks and through the longitudinal sides of the cathode casing.

2. Lining of an aluminum electrolyzer according to claim 1, characterized in that the conductive elements are L-shaped or T-shaped.

3. Lining of an aluminum electrolyzer according to claim 1, characterized in that the bottom blocks are made of high-alumina concrete which is roasted up to 1200° C. or they are made of several layers, a working layer made of high-alumina concrete with thickness of 0.4 to 0.6 of the thickness of the block, and a secondary layer made of alumosilicate concrete, for the rest.

4. Lining of an aluminum electrolyzer according to claim 1, characterized in that the connection between the bottom blocks is made of high-alumina concrete with reduced viscosity or by means of an adhesive or cementing composition with a seam thickness of 5-20 mm.

* * * * *